US010206511B2

(12) United States Patent
Peters

(10) Patent No.: US 10,206,511 B2
(45) Date of Patent: Feb. 19, 2019

(54) UNIVERSAL CHAIR LEVELER

(71) Applicant: Robert F. Peters, Las Vegas, NV (US)

(72) Inventor: Robert F. Peters, Las Vegas, NV (US)

( * ) Notice: Subject to any disclaimer, the term of this patent is extended or adjusted under 35 U.S.C. 154(b) by 0 days.

(21) Appl. No.: 15/712,067

(22) Filed: Sep. 21, 2017

(65) Prior Publication Data

US 2018/0140099 A1 May 24, 2018

Related U.S. Application Data

(60) Provisional application No. 62/426,063, filed on Nov. 23, 2016.

(51) Int. Cl.

| | |
|---|---|
| ***A47C 7/00*** | (2006.01) |
| ***A47B 91/12*** | (2006.01) |
| *A47B 91/02* | (2006.01) |

(52) U.S. Cl.

CPC ..... *A47C 7/008* (2013.01); *A47B 91/12* (2013.01); *A47B 91/024* (2013.01)

(58) Field of Classification Search

CPC ..... A47C 7/008; A47B 91/12; A47B 91/024
USPC ..... 248/188.2, 180.1, 346.05, 188.8, 188.9, 248/688, 615, 673, 677
See application file for complete search history.

(56) References Cited

U.S. PATENT DOCUMENTS 1,165,052 A * 12/1915 William ..... B41J 29/08 135/83
1,554,327 A * 9/1925 Boberg ..... A47B 91/12 16/42 R
1,749,751 A * 3/1930 Bergsten ..... B60B 33/06 16/44
1,810,971 A * 6/1931 Lee ..... B60B 33/04 16/19
1,861,095 A * 5/1932 Schacht ..... A47B 91/12 16/42 R
1,865,899 A * 7/1932 Gohmann ..... A47B 91/12 248/188.2
1,915,320 A * 6/1933 Jones ..... A47B 91/12 188/32
1,973,226 A * 9/1934 Rose ..... E06C 7/46 182/109
2,366,867 A * 1/1945 Nichthauser ..... A47B 91/12 248/188.2
2,371,460 A * 3/1945 Needham ..... E06C 7/44 182/108
2,933,754 A * 4/1960 Winans ..... A47B 91/066 108/118
4,767,105 A * 8/1988 Caspers ..... G11B 33/02 248/188.9
4,793,275 A * 12/1988 Usher ..... B63C 7/006 114/382
4,830,320 A * 5/1989 Bellows ..... A47B 91/12 248/188.2
5,232,187 A * 8/1993 O'Farrell ..... E04F 21/00 248/148

(Continued)

*Primary Examiner* — Muhammad Ijaz
(74) *Attorney, Agent, or Firm* — Lightbulb IP, LLC

(57) ABSTRACT

A universal chair leveler provides chair leveling for outdoor concert, event or other use. The universal chair leveler comprises a body having an angled bottom and a support for receive a chair leg at its top. A support may have one or more distinct cavities to receive various types of chair legs. A telescopic support provides height adjustment to permit use on a variety of sloped or other non-uniform surfaces.

15 Claims, 5 Drawing Sheets

(56) References Cited

U.S. PATENT DOCUMENTS

| | | | | |
|---|---|---|---|---|
| 5,263,551 | A * | 11/1993 | Andersen | B25H 1/06 182/107 |
| 5,427,342 | A | 6/1995 | Gagnon | |
| 5,725,188 | A | 3/1998 | Monteiro | |
| 5,769,371 | A | 6/1998 | Bandur | |
| 6,142,431 | A | 11/2000 | Herzog | |
| 6,374,841 | B1 * | 4/2002 | Yamamoto | A45B 9/04 135/77 |
| 8,407,855 | B2 | 4/2013 | Gagnon | |
| 8,960,784 | B1 * | 2/2015 | De Berry | A47C 7/008 297/16.1 |
| 9,062,466 | B2 | 6/2015 | Glynos | |
| 9,717,336 | B1 * | 8/2017 | Apple | A47B 91/12 |
| 2002/0027091 | A1 * | 3/2002 | Brown | B25H 3/06 206/372 |
| 2003/0126751 | A1 * | 7/2003 | Izumi | E04H 12/2284 33/333 |
| 2005/0103966 | A1 * | 5/2005 | Kim | A47B 91/024 248/346.05 |
| 2015/0289649 | A1 * | 10/2015 | Perrin | A47B 91/12 248/346.06 |
| 2015/0327682 | A1 * | 11/2015 | Green | A47C 7/008 297/313 |
| 2017/0295931 | A1 * | 10/2017 | Macyszyn | A47B 91/02 |
| 2017/0311719 | A1 * | 11/2017 | Vandenham | A47B 91/024 |
| 2018/0140099 | A1 * | 5/2018 | Peters | A47B 91/12 |
| 2018/0271276 | A1 * | 9/2018 | Chartrand | A47B 91/024 |

* cited by examiner

UNIVERSAL CHAIR LEVELER

CROSS-REFERENCE TO RELATED APPLICATION

This application claims priority to U.S. Provisional Patent Application No. 62/426,063, filed Nov. 23, 2016.

BACKGROUND OF THE INVENTION

Field of the Invention

The invention relates to furniture supports and in particular to a universal outdoor chair leveler.

Related Art

Seating is quite often a desirable provision during various activities. Though seemingly simple, comfortable seating can, at times, be difficult to achieve. For example, outdoor areas or venues often do not provide seating or are not well suited for chairs, seats or other seating.

From the discussion that follows, it will become apparent that the present invention addresses the deficiencies associated with the prior art while providing numerous additional advantages and benefits not contemplated or possible with prior art constructions.

SUMMARY OF THE INVENTION

A universal chair leveler is disclosed herein. The universal chair leveler allows users to sit comfortable at a generally level position even on uneven, sloped or otherwise non-uniform surfaces, such as outdoor amphitheaters and venues. The universal chair leveler is also highly portable and may be used with a variety of chairs.

Various universal chair levelers and methods therefore are disclosed herein. In one exemplary embodiment, a chair leveler for leveling a chair on an angled surface is disclosed. The chair leveler comprises a body having a front, a back, a top, and a bottom, wherein the bottom is angled relative to the top. The chair leveler also comprises a plurality of cavities at the top, wherein each of the plurality of cavities has a distinct shape, and one or more telescopic supports movable between an extended position and a retracted position relative to the bottom of the body.

The chair leveler may also have a threaded hole in the body. In such case, the telescopic support will typically comprise a threaded member inserted in the threaded hole. Alternatively, the telescopic supports may be sleeves that surround the periphery of the body.

It is contemplated that a textured surface may be at the bottom of the body for engaging an angled surface. The plurality of cavities may include a first cavity that extends laterally across the top of the body. In addition, the plurality of cavities may include a second cavity that extends perpendicular to the first cavity. Each of the plurality of cavities may be positioned closer to the front that to the back of the body.

In another exemplary embodiment, a chair leveler for leveling a chair on an angled surface comprises a body comprising a front, a back, a top surface, and a bottom surface, the bottom surface angled relative to the top surface to cause the back to be shorter relative to the front. The chair leveler also comprises a first cavity in the top surface, and a second cavity in the top surface. The first cavity and the second cavity have distinct shapes and are positioned closer to the front than to the back of the body.

The chair leveler may also have one or more telescopic supports movable between an extended position and a retracted position relative to the bottom of the body. The telescopic supports may be proximate the front of the body. In addition or alternatively, the telescopic supports may comprise a sleeve that surrounds the periphery of the body.

It is contemplated that the first cavity may extend laterally across the top of the body. The second cavity may extend perpendicular to the first cavity in one or more embodiments. A textured surface may be at the bottom of the body to engage the angled surface.

Various methods of leveling a chair are disclosed herein as well. In general, use of a universal chair leveler will place a chair in a general level position relative to an angled surface. In one exemplary embodiment, a method of leveling a chair on an angled surface with a chair leveler is disclosed. The method comprises providing a body comprising a front, a back, a top having a first cavity and a second cavity therein, and a bottom, wherein the bottom is angled relative to the top to cause the back to be shorter than the front.

The method also comprises engaging the angled surface with the bottom, and receiving a leg of the chair in the first cavity, the second cavity, or both based on a shape of the leg, wherein the first cavity and the second cavity are distinct in shape. The chair is then supported in a generally leveled position relative to the angled surface. The angled surface is engaged by a textured surface at the bottom of the body.

The method may also comprise elevating the front of the body by extending a telescopic support attached to the body. The telescopic support may comprise a sleeve in one or more embodiments. The first cavity and the second cavity may be positioned closer to the front than the back of the body. The first cavity and the second cavity may be perpendicular to one another.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the universal chair leveler allows a user to level a chair in a variety of environments. It is contemplated that the universal chair leveler will typically be used in outdoors, such as sloped amphitheaters or sloped attendee accommodations. The universal chair leveler may also, for example, be used during outdoor amphitheater concerts, festival or events where the seating surface is sloped toward the stage, on a hillside or uneven grass field. The universal chair leveler may also be used for outdoor sports and recreation where uneven land, ground, sloping terrain exists, such as along riverbanks, steams, ponds and lakes where a chair would be uncomfortable or unsafe or uncomfortable without leveling. The universal chair leveler may also be used for fishing, camping, picnics, watching sporting event and other activities.

The universal chair leveler may also be used on sloped or uneven ground, during fishing, picnics, bird watching, reading and other activities. As will be described further below, the universal chair leveler may be adjustable in one or more embodiments for use with various degrees of slope. In addition, the universal chair leveler may be stackable to allow a plurality of universal chair levelers to be easily transported, distributed, and stored.

Figure 1:
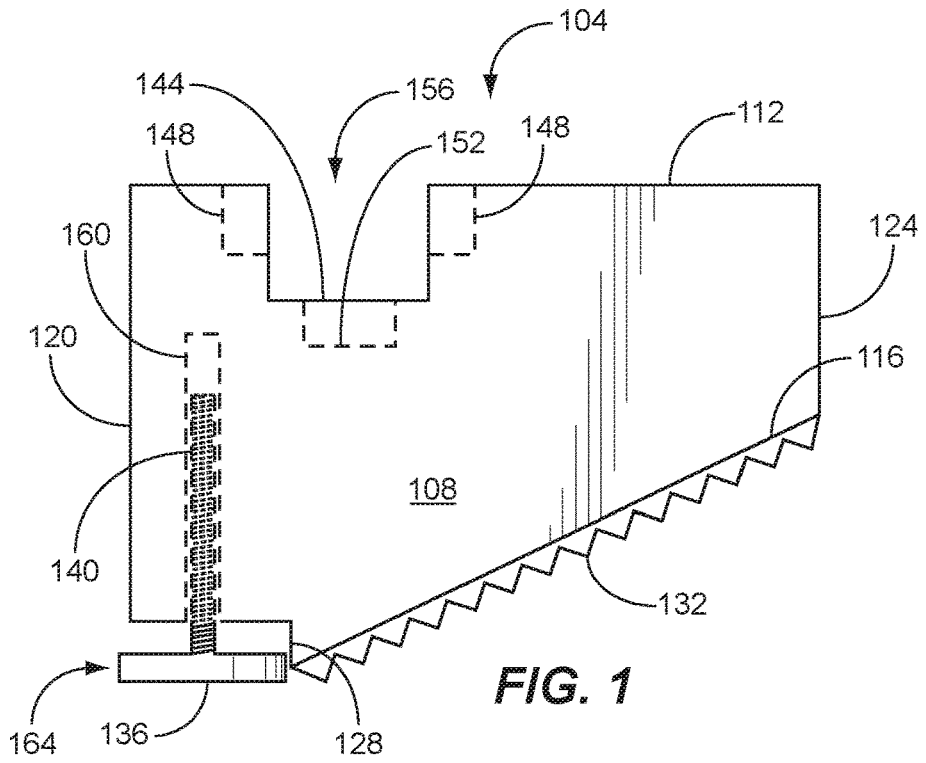
FIG. 1 is a side view of an exemplary universal chair leveler.

FIG. 1 illustrates a side view of an exemplary universal chair leveler 104. As can be seen, a universal chair leveler 104 may comprise a body 108 having a top 112, bottom 116, front 120 and back 124. A top 112, front 120 and back 124 may be generally planar, such as shown. A body 108 may be formed from a rigid material, such as wood, plastic, metal or the like.

A bottom 116 of a universal chair leveler 104 may be sloped to engage a sloped amphitheater or accommodation floor surface. In one or more embodiments, a tread 132 or other textured surface may be attached or applied to the bottom 116 to prevent a universal chair leveler 104 from sliding when in use. It is contemplated that a tread 132 may comprise a resilient material, such a rubber, to function as a friction inducing surface.

A socket 156 may be formed in the body 108, such as in the top 112 of the body, and be shaped to receive one or more chair legs. To illustrate, a socket 156 may comprise one or more cavities 144, 148, 152 to receive chair legs of various shapes. In the exemplary embodiments of FIGS. 1 and 2 for instance, socket 156 comprising a rectangular cavity 144, a square cavity 148 and a circular cavity 152 are provided. This allows the universal chair leveler 104 to receive chair legs with corresponding or similar shapes via a socket 156. Since the cavities 144, 148, 152 of a socket 156 are inset, a chair leg can be received and retained therein.

Figure 2:
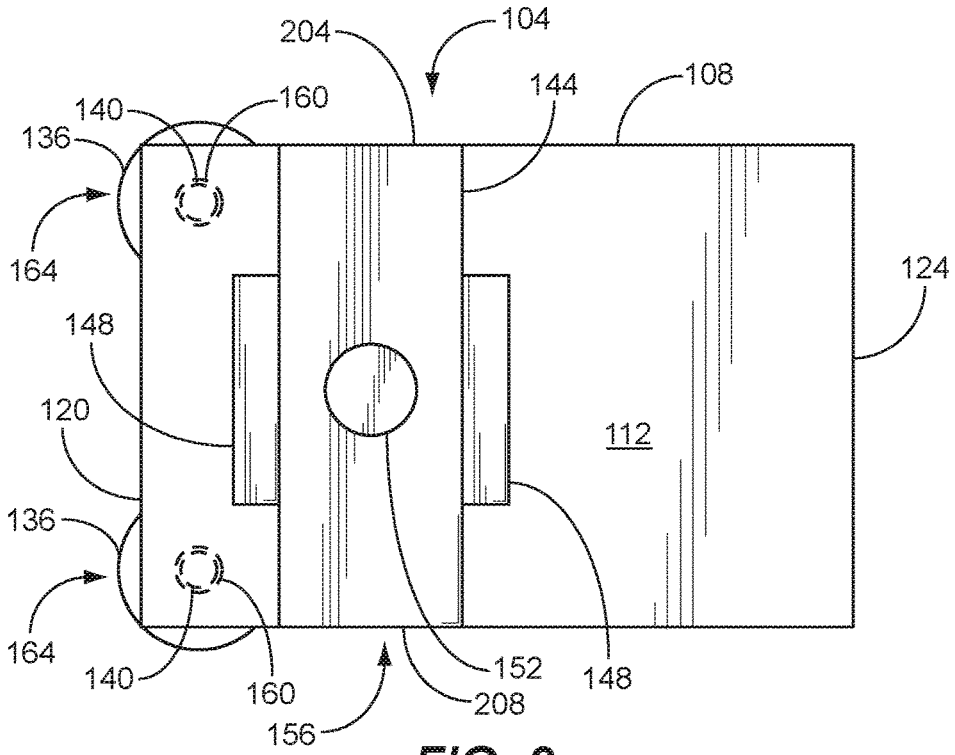
FIG. 2 is a top view of an exemplary universal chair leveler.

It is contemplated that a universal chair leveler 104 may be height adjustable in one or more embodiments. The universal chair levelers 104 of FIGS. 1 and 2 are height adjustable at the front 120 for example. As stated above, this allows a universal chair leveler 104 to be used on slopes of various degrees. It is contemplated that height adjustment may be accomplished in various ways.

As shown in FIGS. 1 and 2, it can be seen that a universal chair leveler 104 may comprise one or more adjustment feet 164 at a front 120 of the universal chair leveler. A telescopic support or portion 164 may comprise a threaded rod 140 with an enlarged portion 136 that forms a foot. One or more threaded openings 160 may be in the body 108 of a universal chair leveler 104 to receive the threaded rod 140 of a telescopic support 164.

A threaded opening 160 may open at a bottom 116 of a universal chair leveler 104 such that height adjustment occurs at the bottom of the universal chair leveler. In operation, height adjustment may be accomplished by extending or retracting a telescopic support 164. This may be accomplished by rotating the telescopic support 164 until its threads carry the telescopic support to a desired position.

Referring to FIG. 2, it can be seen that one or more adjustable feet 164 may be at the sides 204, 208 of a universal chair leveler 104. Each of the adjustable feet 164 may be independently adjustable, such as to accommodate a venue that is sloped in a lateral direction or that otherwise does not have a uniform surface. Independent adjustment may occur by independently rotating each telescopic support 164 to a desired position.

In one or more embodiments, an inset 128 may be formed in the bottom 116 to receive the enlarged portion 136 of a telescopic support 164. An inset 128 is not required but may be provided to allow a telescopic support 164 to fully retract such that its enlarged portion 136 is flush with the bottom 116 of the body 108.

Figure 3:
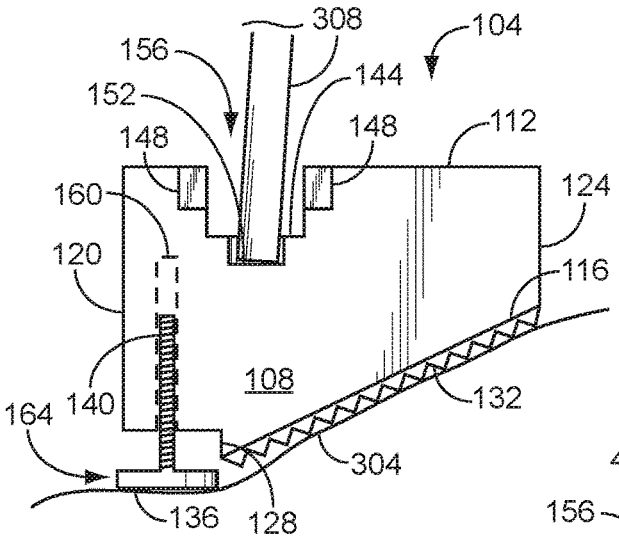
FIG. 3 is a side view of an exemplary universal chair leveler in use.
Figure 4:
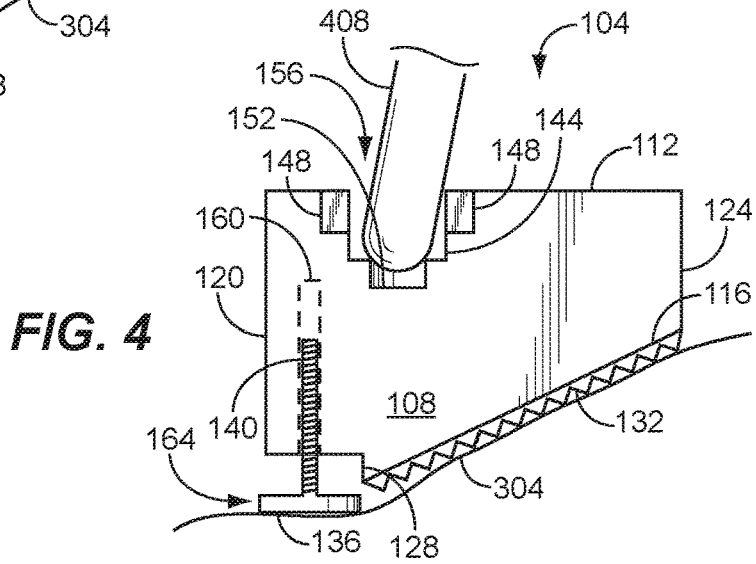
FIG. 4 is a side view of an exemplary universal chair leveler in use.
Figure 5:
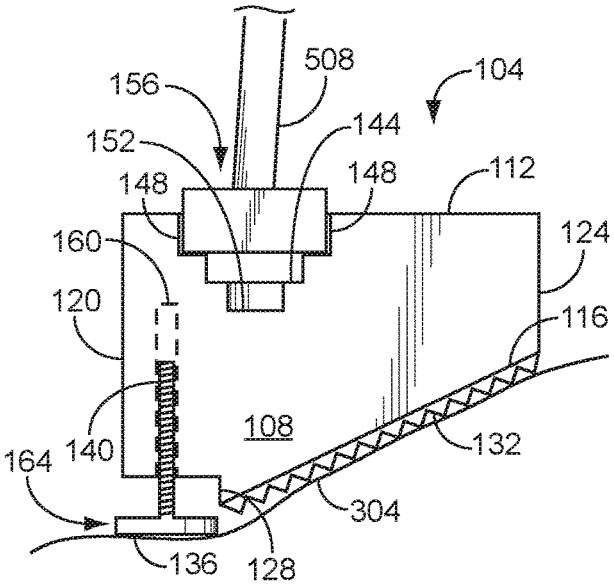
FIG. 5 is a side view of an exemplary universal chair leveler in use.

FIGS. 3-5 illustrate an exemplary universal chair leveler 104 in use with various chairs. As can be seen, a socket 156 of a universal chair leveler 104 may receive various chair legs 308, 408, 508 and elevate the same relative to a sloped surface 304. In FIG. 3, a traditional chair leg 308, such as that of a patio, camping or folding chair, has been received in a circular cavity 152 of the socket 156. In FIG. 4, a "U" shaped beach chair leg 408 has been received in a rectangular cavity 144 of the socket 156. It is noted that a rectangular cavity 144 may have open sides, such as shown in FIG. 1, permit a beach chair leg 408 or the like to extend out one or both sides of the rectangular cavity 144. In FIG. 5, a folding chair leg 508 has been received in a square cavity 148 of the socket 156. It is noted that a square stacking chair leg or other similarly shaped chair leg may be received in the square cavity 148.

Cavities of various shapes and sizes may be provided. In addition, additional or fewer cavities may be provided in some embodiments. It is contemplated that a user may select which cavity to utilize based on the size, shape or both of a chair leg. In general, a universal chair leveler 104 will receive one or more front legs of a chair. It is contemplated that a back leg may also be received by a universal chair leveler 104. Also, though a pair of universal chair levelers 104 will typically be used at the front legs of a chair, it is contemplated that other numbers of universal chair levelers may be used at one or more legs of a chair such as desired to compensate for the terrain or surface upon which the chair is to be placed.

Figure 6:
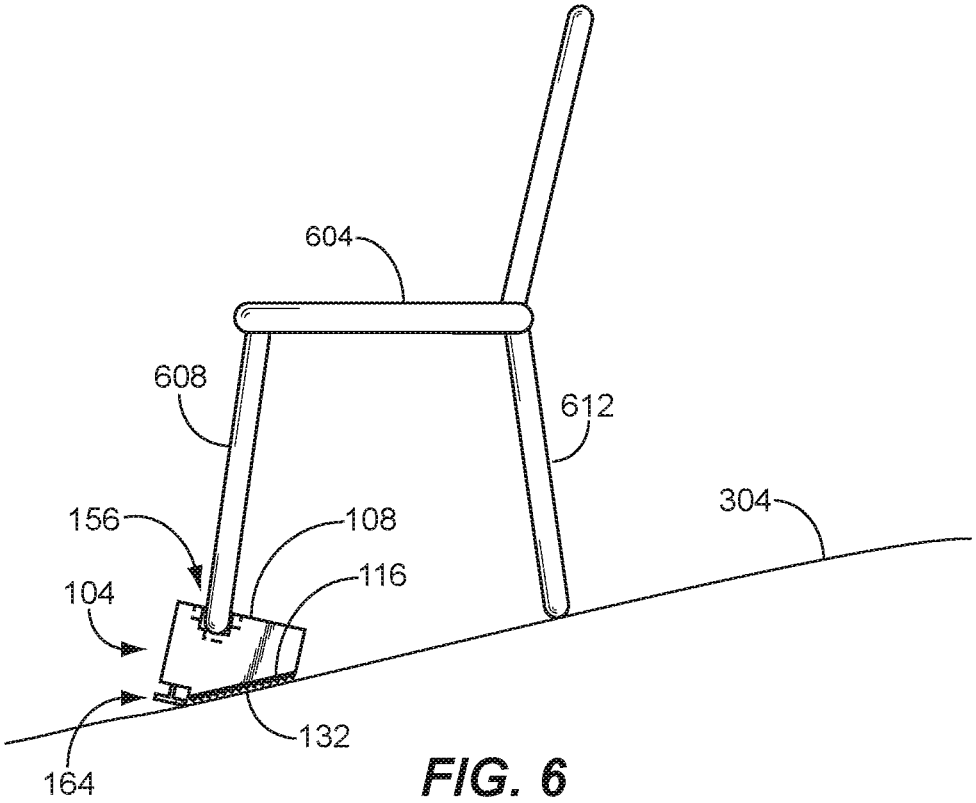
FIG. 6 is a side view of an exemplary universal chair leveler in use.

Referring to FIG. 6, it can be seen, that a universal chair leveler 104 provides leveling to a chair 604 on a sloped surface 304 or other uneven surfaces. In the example of FIG. 6, the universal chair leveler 104 receives a front leg 608 of a chair 604 and elevates it such that it is substantially level with a back leg 612 of the chair. This provides a more level seating surface upon which a user may sit comfortably.

Without the universal chair leveler 104, the chair 604 would be unstable and a user would be prone to sliding out of the seat. In addition, the user would not be comfortable, especially over long periods of time.

Figure 7:
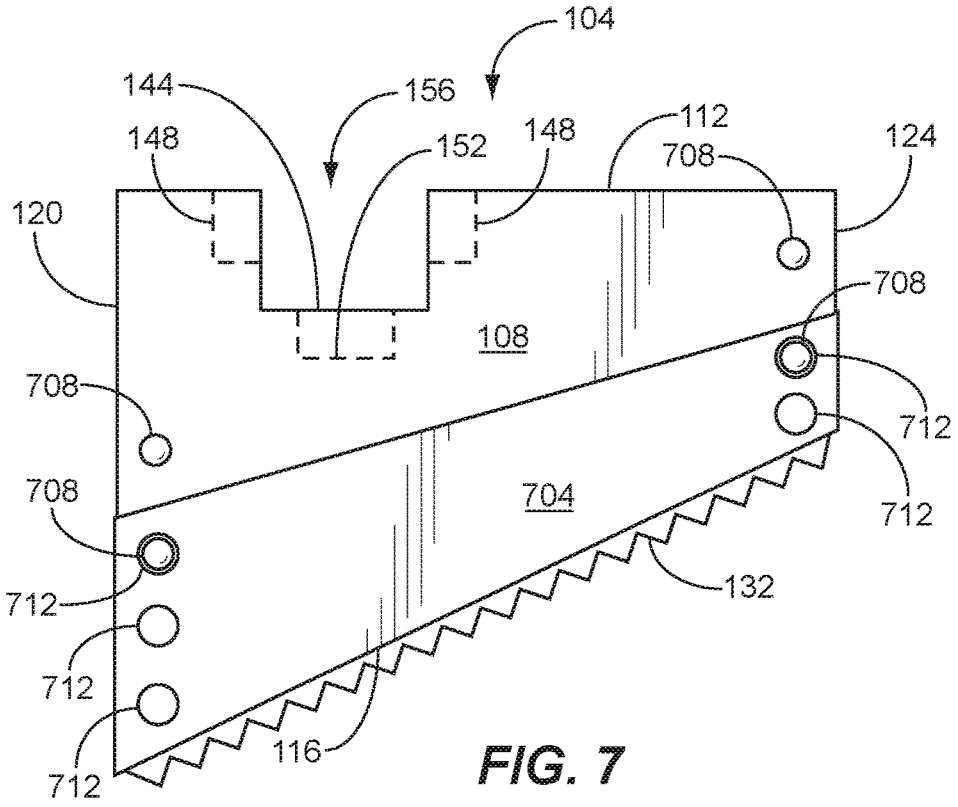
FIG. 7 is a side view of an exemplary universal chair leveler.
Figure 8:
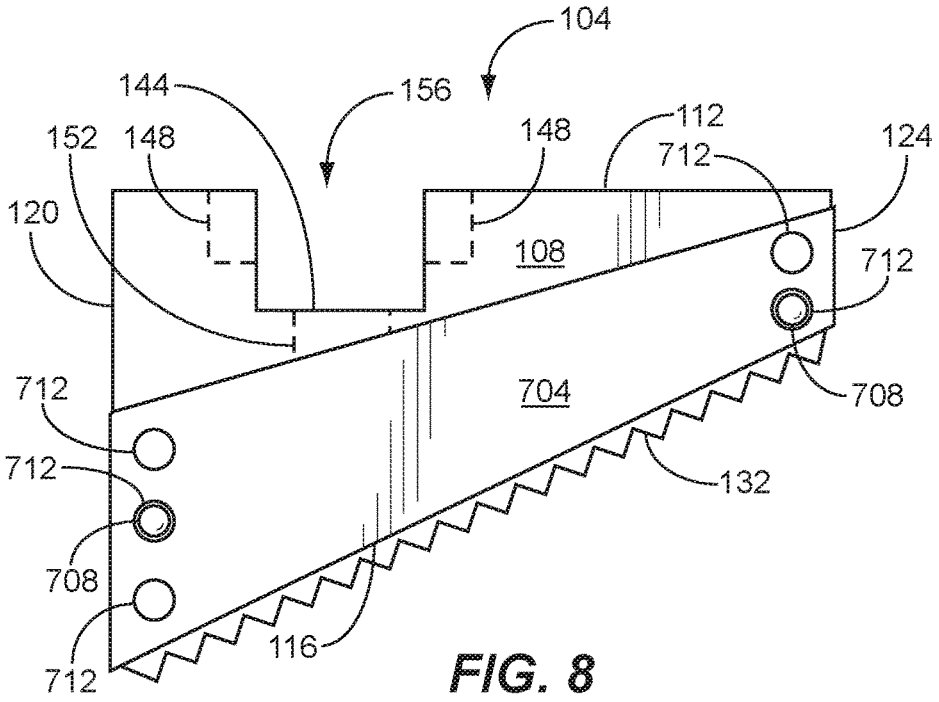
FIG. 8 is a side view of an exemplary universal chair leveler.

Height adjustment may be accomplished in various ways. As can be seen from FIGS. 7 and 8, a universal chair leveler 104 may comprise one or more different telescopic supports 704 that extend and retract to respectively increase and decrease the height of a universal chair leveler. FIG. 7 illustrates a universal chair leveler 104 in an extended state, while FIG. 8 illustrates a universal chair leveler in a retracted state.

A telescopic support 704 may comprise one or more openings 712 to allow the telescopic support to be held at a particular position. As can be seen in FIGS. 7 and 8 a set of openings 712 may be provided to allow a telescopic support to be held at a variety of positions. A body 108 of a universal chair leveler 104 may have one or more pegs 708 that extend into or otherwise engage an opening 712 to hold a telescopic support 704 in place. Similar to the openings 712 a set of pegs 708 may be provided to hold a telescopic support 704 at a variety of positions. It is contemplated that a peg 708 may be retractable or removable to allow a telescopic support 704 to be moved to and secured at various positions.

During adjustment, a user may select a peg 708 and corresponding opening 712 that provides a desired height for the universal chair leveler 104. In FIG. 7 for instance, an upper set of openings 712 of a telescopic support 704 engage a lower set of pegs 708 of a body 108, causing the universal chair leveler 104 to have a first height. In FIG. 8, a lower set of openings 712 engage an upper set of pegs 708, causing the universal chair leveler 104 to have a second reduced height. It can be seen that various combinations of pegs 708 and openings 712 may be used to provide various heights.

A telescopic support 704 may also comprise a bottom 116 that may have a tread 132 or the like. As such, the bottom 116, tread 132 or both move with a telescopic support 704 and support the universal chair leveler 104 on the surface upon which it is placed.

Figure 9:
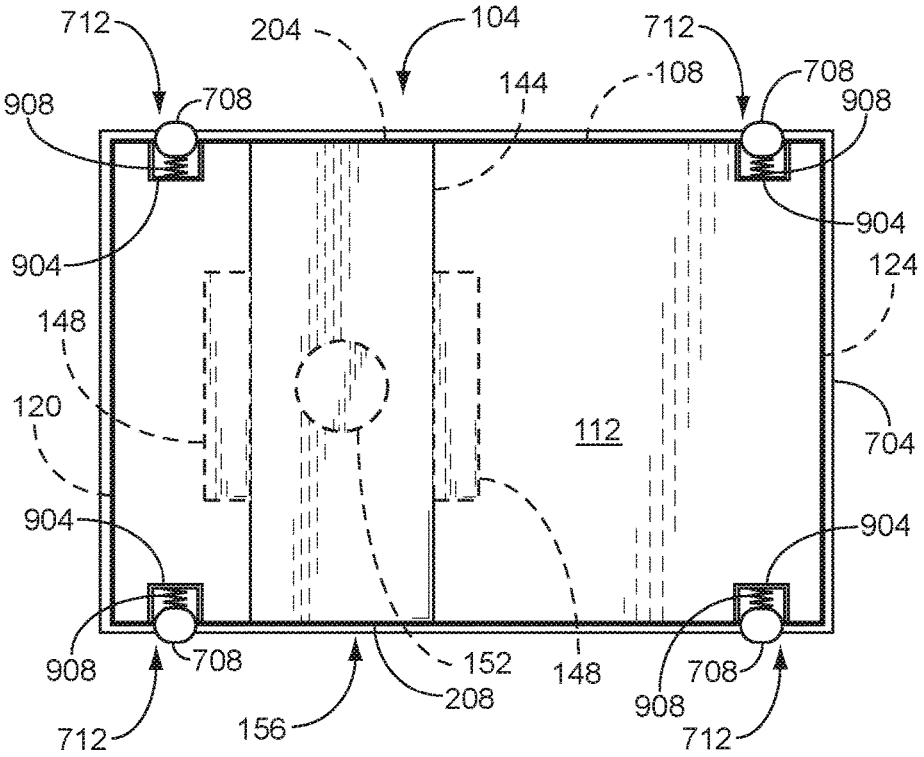
FIG. 9 is a top cross-sectional view of an exemplary universal chair leveler.

FIG. 9 illustrates a top cross-sectional view of a universal chair leveler 104 having a telescopic support 704. As can be seen, a telescopic support 704 may comprise a sleeve which wraps around the periphery of the body 108 of a universal chair leveler 104. It is contemplated that a body 108 and telescopic support 704 may be flared so as to prevent the telescopic support from sliding off the body when unsecured.

In addition, a plurality of telescopic supports 704 may be provided in some embodiments. Each telescopic support 704 may be a sleeve structure that conforms to the periphery of another telescopic support or body 108 therein. A peg 708 may be enlarged or lengthened such that it is capable of engaging each telescopic support 704 to hold the telescopic supports in a desired position. At least one of the telescopic supports 704 may comprise a bottom 116, tread 132 or both that engages a floor or other surface, such as described above.

As can be seen, a peg 708 may be part of a peg assembly comprising a cavity or sleeve 904 having a biasing device 908, such as a spring, therein. A peg 708 may biased outward by a biasing device 908, such as shown. In this manner, a user may depress one or more pegs 708 such that it no longer engages and opening 712 to free or release a telescopic support 708. The telescopic support 704 may then be moved to a desired position. A biasing device may then extend the peg 708 into an opening 712 of the telescopic support 704 at such position.

One or more peg assemblies may be provided. As shown in FIG. 9 for example, two pairs of peg assemblies are provided at a front 120 and back 124 of the universal chair leveler 104. In one or more embodiments, a compartment 904 may be at or in a body 108 of a universal chair leveler 104.

It is contemplated that a peg assembly need not have a biasing device 908 in all embodiments. For example, in some embodiments, a peg assembly may have a peg 908 and a compartment 904, whereby the peg may be removed from the sleeve to free or release a telescopic support 704. Once a desired position is achieved, the peg 708 may be inserted into an opening 712 of the telescopic support 704 and the compartment 904 to secure the telescopic support in place.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A chair leveler for leveling a chair on an angled surface comprising:

a body having a front, a back, a top, and a bottom, wherein the bottom is angled relative to the top;

a first cavity that extends laterally in the top of the body and is open at both sides of the body;

a second cavity in the top of the body having a dimension larger than the first cavity, the dimension extending perpendicular to the first cavity;

a third cavity open towards the top and having a periphery smaller than the first cavity and the second cavity; and one or more telescopic supports movable between a first position wherein the height of the chair leveler is extended and a second position wherein the height of the chair leveler is retracted;

wherein the first cavity, the second cavity, and the third cavity are axially aligned with respect to one another.

2. The chair leveler for leveling a chair on an angled surface of claim 1 further comprising a threaded hole in the body, wherein the telescopic support comprises a threaded member inserted in the threaded hole.

3. The chair leveler for leveling a chair on an angled surface of claim 1, wherein the one or more telescopic supports are sleeves that surround the periphery of the body.

4. The chair leveler for leveling a chair on an angled surface of claim 1 further comprising a jagged surface at the bottom.

5. The chair leveler for leveling a chair on an angled surface of claim 1, wherein each of the first cavity, the second cavity, and the third cavity is positioned closer to the front that to the back of the body.

6. A chair leveler for leveling a chair on an angled surface comprising:

a body comprising a front, a back, a top surface, and a bottom surface, the bottom surface angled relative to the top surface to cause the back of the chair leveler to be shorter relative to the front;

a first cavity that extends laterally in the top surface and is open at both sides of the body; and a second cavity in the top surface having a dimension larger than the first cavity, the dimension extending perpendicular to the first cavity; and a third cavity open towards the top surface and having a periphery smaller than the first cavity and the second cavity;

wherein the first cavity and the second cavity have distinct shapes;

wherein the first cavity, the second cavity, and the third cavity are axially aligned with respect to one another.

7. The chair leveler for leveling a chair on an angled surface of claim 6 further comprising one or more telescopic supports movable between a first position wherein the height of the chair leveler is extended and a second position wherein the height of the chair leveler is retracted.

8. The chair leveler for leveling a chair on an angled surface of claim 7, wherein the one or more telescopic supports are proximate the front of the body.

9. The chair leveler for leveling a chair on an angled surface of claim 7, wherein the one or more telescopic supports comprise a sleeve that surrounds the periphery of the body.

10. The chair leveler for leveling a chair on an angled surface of claim 6 further comprising a jagged surface at the bottom.

11. A method of leveling a chair on an angled surface with a chair leveler comprising:

providing a body comprising a front, a back, a top having a first cavity, a second cavity, and a third cavity therein, and a bottom, wherein the bottom is angled relative to the top to cause the back to be shorter than the front;

wherein the first cavity extends laterally across the top and is open at both sides of the body, the second cavity has a dimension larger than the first cavity, the dimension extending perpendicular to the first cavity, the third cavity open towards the top and has a periphery smaller than the first cavity and the second cavity;

engaging the angled surface with the bottom;

receiving a leg of the chair in the first cavity, the second cavity, or both based on a shape of the leg, wherein the first cavity and the second cavity are distinct in shape; and supporting the chair in a generally leveled position relative to the angled surface;

wherein the first cavity, the second cavity, and the third cavity are axially aligned with respect to one another.

12. The method of claim 11 further comprising elevating the front of the body by extending a telescopic support attached to the body.

13. The method of claim 11 wherein the telescopic support comprises a sleeve.

14. The method of claim 11, wherein the first cavity and the second cavity are positioned closer to the front than the back of the body.

15. The method of claim 11, wherein the angled surface is engaged by a jagged surface at the bottom of the body.

* * * * *